United States Patent [19]

Noraberg

[11] 4,289,105

[45] Sep. 15, 1981

[54] FUEL INJECTION PUMP FOR A COMPRESSION-IGNITION ENGINE

[75] Inventor: John Noraberg, Graz, Austria

[73] Assignee: Hans List, Graz, Austria

[21] Appl. No.: 3,971

[22] Filed: Jan. 16, 1979

[30] Foreign Application Priority Data

Jan. 17, 1978 [AT] Austria ..... 330/78

[51] Int. Cl.[3] ..... F02M 59/26

[52] U.S. Cl. ..... 123/500; 123/501; 123/503

[58] Field of Search ..... 123/139 AP, 139 AY, 123/139 BD, 139 AE, 139 AR, 140 R

[56] References Cited

U.S. PATENT DOCUMENTS

| | | | |
|---|---|---|---|
| 1,847,718 | 3/1932 | Herr | 123/139 AP |
| 3,930,482 | 1/1976 | Akashi | 123/139 AR |
| 4,013,055 | 3/1977 | Sommer | 123/139 BD |

FOREIGN PATENT DOCUMENTS

| | | | |
|---|---|---|---|
| 794982 | 2/1936 | France | 123/139 AR |
| 345097 | 11/1929 | United Kingdom | 123/139 AR |
| 489660 | 8/1938 | United Kingdom | 123/139 AR |

*Primary Examiner*—Charles J. Myhre
*Assistant Examiner*—Carl Stuart Miller

[57] ABSTRACT

A fuel injection pump for a compression-ignition engine includes a cylinder having a bore therein and a pump piston which is mounted not only to reciprocate within the bore past a fuel supply port but also rotate therewithin. The pump piston has upper and lower control surfaces which each have a bowed shape. The center or centers of the control edges lies or lie above them, and in the region between the upper part loads and full load in the direction towards full load the upper control edge has a rising shape while the lower control edge has a falling shape. The lower control edge, by comparison with the remainder of its extent falls progressively less steeply towards full load and the upper control edge rises increasingly steeply, so that the compensation of delivery in accordance with speed is achieved predominantly by the upper control edge and there is obtained a speed-dependent advance of the start of delivery.

2 Claims, 3 Drawing Figures

FUEL INJECTION PUMP FOR A COMPRESSION-IGNITION ENGINE

BACKGROUND OF THE INVENTION

This invention relates to a diesel injection pump with inclined edge control and a speed governor and with a device combined with the latter for compensating the delivery quantity, the adjusting movement of a sleeve of the governor in accordance with speed acting through a lever system and a control rod on the injection pump plunger.

DESCRIPTION OF THE PRIOR ART

To achieve favourable fuel consumption and exhaust gas emission characteristics in diesel engines, the existence of a quite specific injection timing for every operating condition is of great significance. The required injection timing is dependent on several operating parameters, the dependence of the injection timing on speed being particularly decisive. More or less expensive added-on devices are required according to the injection system. In the known injection systems of diesel engines the adjustment of the injection timing in accordance with speed is usually achieved by automatic rotation of the injection pump cam shaft in relation to the crank shaft. Such a device for adjusting the injection timing is not only expensive but it furthermore increases the overall weight of the engine by an amount which is by no means insignificant, and it increases the space it occupies. This fact becomes of increasing significance in the light of endeavours to construct diesel engines as light as possible and at the same time compact and of high output.

Particularly expensive is the automatic device for adjusting the injection timing in accordance with speed where it is applied to so-called pump nozzle elements, that is to say, in which each cylinder has its own injection pump combined with the injection nozzle. In this injection system the injection cams are mounted on a cam shaft in common with the inlet and exhaust valve cams. Automatic adjustment of the injection by relative movement of the pump cam shaft in relation to the crank shaft is impossible with this system. With this system the adjustment of the injection timing is achieved with the aid of an eccentric-carrying shaft on which the rocking levers that actuate the injection pump elements are mounted. This construction requires relatively high adjusting forces and is very expensive, and furthermore it restricts the design possibilities.

What is sought is a device which allows the injection timing to be adjusted automatically in accordance with the speed without making it necessary to provide further additional devices beyond those normal in diesel injection pumps. Modern diesel injection pumps usually have a so-called delivery compensating device which works in combination with the speed governor. The delivery compensating device has the function of matching the so-called locked injection delivery pattern over the speed to the requirements of the engine. By the phrase "locked injection delivery pattern" is meant the variation of the quantity of fuel injected over the speed with the control rod locked, and it generally departs significantly to some extent, and in particular at high engine speeds, from the pattern of delivery which one is aiming at, as a consequence of hydraulic effects. In order to compensate for this departure the adjusting movement of the governor sleeve in accordance with speed is employed so that, through a lever system, it acts on the control rod of the injection pump or of the pump nozzle elements and - in the case of a so-called minus or negative compensation - so as to achieve, with increasing engine speed, rotation of the injection pump plunger in a direction to cause increased delivery. In most of the known injection systems an upper control edge of the injection pump plunger lies in a plane perpendicular to the axis of the plunger and a lower control edge is usually inclined to the axis of the plunger. This has the consequence that the instant at which delivery starts is constant and the increased quantity required for compensation is achieved by the delay, produced by the lower control edge, of the end of the delivery stroke with increasing rotation of the plunger.

In French Patent Specification No. 1,093,960 there are described injection pump pistons in which the upper and lower control edges are of bowed shape in developed form. The centers of curvature lie, in this arrangement, below the control edges so that the latter are convex towards the upper end of the piston. The rise of the upper control edge in the direction towards full load is progressively less steep and the fall of the lower control edge in a direction towards full load is increasingly steeper. This signifies that compensation of the quantity of fuel injected in the region of full load is effected predominantly by delaying the end of delivery and accordingly with this arrangement it is not possible to obtain any advance of the start of delivery in accordance with speed.

In East German Patent Specification No. 124 932 there is described an injection pump piston in which the upper and lower control edges are made straight. A curved form for the control edges is possible in principle but with such an arrangement likewise the centers of curvature of the control edges lie below the latter. Furthermore the upper control edge according to East German Patent Specification No. 124 932 has a profile which falls away towards the full load position in the region of the upper part-load range and full load, in order to achieve, in this region, a delay of the start of the injection with the aim of keeping down the peak pressures.

SUMMARY OF THE INVENTION

It is an object of the invention to enable the injection timing to be adjusted in accordance with speed without additional devices.

The present invention consists in a fuel injection pump for a compression-ignition engine and provided with inclined edge control and a speed governor and with a device combined with the latter for compensating the delivery quantity, the speed governor having an output member the adjusting movement of which in accordance with speed acts through a lever system and a control rod on the injection pump plunger, of which the upper and lower control edges have a bowed shape in developed form the center or centers of which lies or lie above the control edges, and in the region between the upper part loads and full load in the direction towards full load the upper control edge has a rising shape whilst the lower control edge has a falling shape, the lower control edge, by comparison with the remainder of its extent falling progressively less steeply towards full load and the upper control edge rising increasingly steeply, so that the compensation of delivery in accordance with speed is achieved predominantly by the upper control edge and there is obtained a speed-dependent advance of the start of delivery.

The correcting movement of the compensating device necessary for correcting the delivery quantity is thus advantageously employed, with the aid of appropriately shaped control edges, to make it possible to adjust the injection timing in accordance with speed. It should be emphasized that a particular advantage of this solution is that no additional device is required on the injection pump or the pump nozzle elements, other than appropriate shaping of the injection pump plungers. By the shape and the relative positions of the upper and lower control edges in relation to each other there is the possibility of influencing the injection timing in accordance with load as well, whilst leaving the adjustment of the start of injection in accordance with speed undisturbed. Finally it is of advantage that, with an appropriate shape of cam, the mean rate of delivery is increased with falling engine speed and can be matched better to a large speed range.

According to a further feature of the invention the lower control edge can be inclined less than the upper control edge in the region between the upper part load range and full load. In this way it is possible to obtain optimum adjustment of the injection timing in accordance with speed. A further possibility for matching the adjustment of the injection timing can be obtained if, in the region between the upper part load range and full load, the direction of inclination of the lowermost control edge becomes reversed so that in the region of the full load setting the lowermost control edge extends in the same sense as the uppermost control edge. In this way it is possible to deliver the required compensating quantity partially or wholly over the start of the delivery advanced in accordance with the upper control edge, or also to advance the entire injection process.

The adjustment of the start of delivery that can be obtained in accordance with speed is dependent on the maximum correction of the delivery quantity by the delivery compensating device. Influence on the necessary correction quantity is possible by adjustment of the starting data of the injection system such as dead volume (dilation) in the high pressure part, nozzle orifice cross-section, unloading system, cam shape, etc., generally without adversely affecting important engine characteristics such as fuel consumption and exhaust gas emissions. This is possible to an extent which is suitable, in conjunction with the started arrangements of the control edges and the compensating device of the governor, to achieve adequate adjustment of the injection in accordance with speed.

DESCRIPTION OF THE DRAWINGS

The invention is further explained, by way of example, with reference to the accompanying drawings in which.

DESCRIPTION OF THE PREFERRED EMBODIMENT

Figure 1:
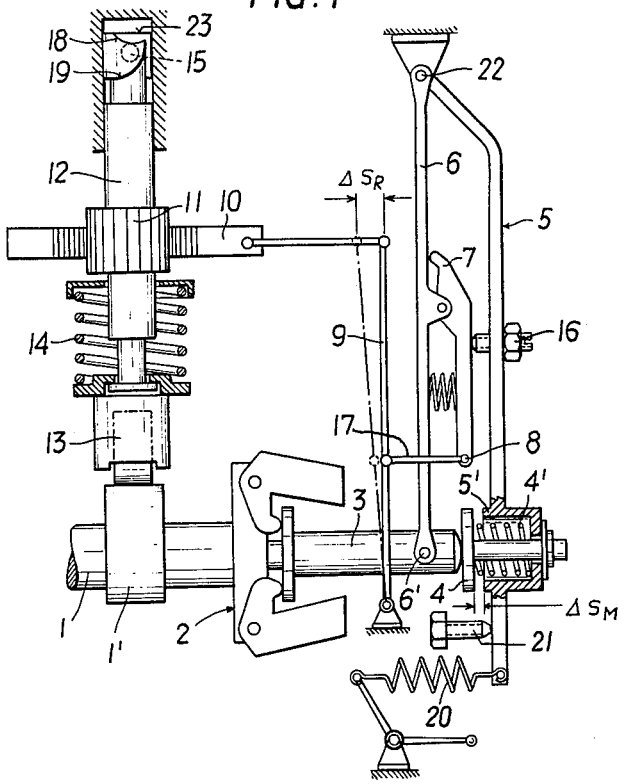
FIG. 1 shows diagrammatically an injection pump with a speed governor and a delivery compensating device.

In FIG. 1 a cam shaft 1 for the injection pump is shown. A speed governor 2 is connected to the cam shaft 1 and has a sleeve 3 which acts on a spring-loaded adjustable stop 4 mounted in a lever 5 sharing a fixed pivot 22. A lever 6, also pivoted about the pivot 22, is pivotally connected to the sleeve 3 of the governor 2 and has a motion-reversing lever 7 pivotally mounted on it and spring loaded away from it. An adjusting screw 16, which is mounted on the lever 5, is arranged to abut the lever 7 below its pivot after relative movement between the levers 5 and 6 determined by the setting of the adjusting screw 16. An adjustable stop 21 limits the movement of the lever 5 which is waged towards the full-load postition by a pre-loaded governor spring 20. The lever 7 is connected at a pivot 8 to a link 17 which, via a governor lever 9, is ultimately connected to a control rod 10 of the injection pump. The control rod 10 has its rack portion engaging a control pinion 11 of a plunger 12 of the injection pump. The plunger 12 is actuated by a cam 1' through a roller 13, indicated diagrammatically, against the force of a spring 14. In the wall of the injection pump cylinder in which the plunger 12 slides is a control port 15. Upwardly concave bowed edges 18 and 19 on the plunger 12 cooperate with the control port 15 on movement of the plunger 12 along and angularly about its axis. The centers of the control edges 18 and 19 lie above the control edges.

The device exhibts a so-called negative or minus compensation. In the position of the governor which is shown, the force of the sleeve 3 at the lowest full-load speed is in balance with the force of the compensating spring 4'. In the developed view of the control edges in FIG. 2, the control port 15 at lowest full-load speed is at a, and here the initial part of the stroke is shown in FIG. 3 at $h_{01}$ and the delivery starts at $\alpha_{01}$. $\alpha$ is the position of the cam shaft in degrees of angle with reference to the cam shaft. As the engine speed rises, the spring 4' is compressed more and more until, when maximum full-load speed is reached, the stop 4 comes into engagement with the stop 5' of the lever 5. At this time the pivot point 6' of the lever 6 has moved to the right through the distance $\Delta s_m$, the motion-reversing lever 7 has likewise been moved to the right by movement of the lever 6, and because of the stop formed by the adjusting screw 16, it has turned in a clockwise direction. This angular movement is transmitted through the pivot 8 and the link 17 to the governor lever 9 and, as a consequence, to the control rod 10. In accordance with the leverage ratios, the control rod 10 has thus moved to the left through the distance $\Delta s_r$. This movement is transmitted through the pinion 11 to the plunger 12, of which the control edges 18,19 have been brought to the position b by angular displacement through the distance $\Delta s_u$ of the periphery relative to the control port 15 in FIG. 2. As a result, the delivery stroke is increased from $h_1$ to $h_2$, which produces the correct full load delivery at maximum speed and simultaneously, in accordance with the shape and position of the uppermost control edge 18, the pre-travel or stroke is reduced by the amount $\Delta h_o$ which, in accordance with the cam shape in FIG. 3, corresponds to an advance of the start of delivery by the amount $\Delta\alpha$. At the same time the angle-dependent velocity at the start of the delivery stroke falls from $v_{01}$ to $v_{02}$ in FIG. 3. This signifies an advantageous matching of the rate of delivery to engine speed. On further increase in engine speed, the pre-loading of the governor spring 20 is overcome and the direction of movement of the control rod 10 is reversed. This causes the usual regulation back from the full-load stop 21 to the upper idling position shown at c in FIG. 2. By the movement in common of the pivot point 6' on the governor sleeve 3 and of the stop 4, which is now engaging the lever 5, the levers 5,6,7 all move together about the pivot point 22 as a single lever.

Figure 2:
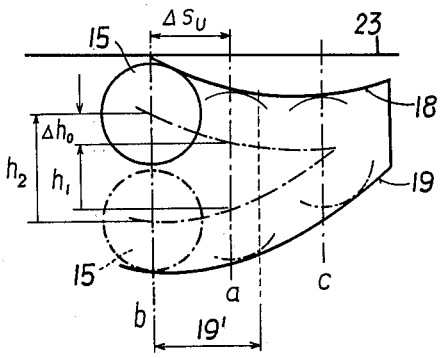
FIG. 2 shows in developed form the control edges of an injection pump plunger according to the invention.
Figure 3:
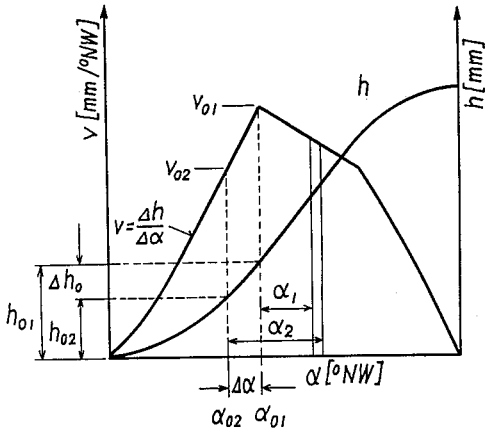
FIG. 3 shows an example of a cam profile characterized by the stroke and velocity behaviour.

In the developed form of the control edges of the plunger 12 illustrated in FIG. 2, the upper control edge 18 has a shape, from about the position a corresponding to the lowest full-load speed, with a profile which rises towards an upper end 23 of the plunger. The lower control edge, which determines the end of the injection, has, in the region between the position a corresponding to the lowest full-load speed and the position b corresponding to the maximum full-load speed, a substantially more gently-inclined profile. The region between the upper part-load range and full-load is indicated at 19' in FIG. 2. By this formation of the control edges the result is achieved that the end of delivery remains nearly constant along the full-load line with increasing speed and that the required compensating quantity is achieved predominantly by the start of the delivery being advanced by the upper control edge 18.

I claim:

1. In a fuel injection pump for a compression-ignition engine which includes a fuel injection cylinder having an internal cylindrical bore, at least one control port communicating with said bore to supply fuel thereto or remove fuel therefrom, and a piston which is mounted so as to be axially reciprocated within said bore, as well as rotated therewithin, said piston including an upper control edge which determines initiation of fuel injection and a lower control edge which determines termination of fuel injection as the upper and lower control edges move past said control port, and with rotation of said piston determining the relative timing of movement of the control edges past said control port, the improvement wherein the upper and the lower control edges of said piston, when viewed in a vertical cross-section, extend with respect to an imaginary plane at the upper end of the piston perpendicular to the axis of said bore and in a direction between the respective axial points along said control edges which lie in the zone between the axial line along the piston which corresponds to a zone of the partial load area of the piston near the full load area thereof and the axial line which corresponds to the full load area, the partial load area being that portion of the piston which cooperates with the respective control bore during the partial load operation of the compression-ignition engine, as follows: the upper control edge curving upwardly towards said imaginary plane and the lower control edge curving downwardly and including a portion nearest the full load area which curves at a lower angle of inclination than the corresponding curved portion of said upper control edge.

2. The pump of claim 1 wherein said lower control edge curves first downwardly and then upwardly in the zone nearest the full load area.

* * * * *